US011441211B2

(12) United States Patent
Han et al.

(10) Patent No.: US 11,441,211 B2
(45) Date of Patent: Sep. 13, 2022

(54) METHOD FOR PRODUCING ALLOY STEEL

(71) Applicant: POSCO, Pohang-si (KR)

(72) Inventors: Woong Hee Han, Gwangyang-si (KR); Chong Tae Ahn, Gwangyang-si (KR); Soo Chang Kang, Gwangyang-si (KR); Jun Jeong Beak, Gwangyang-si (KR); Min Ho Song, Gwangyang-si (KR)

(73) Assignee: POSCO, Gyeongsangbuk-Do (KR)

( * ) Notice: Subject to any disclaimer, the term of this patent is extended or adjusted under 35 U.S.C. 154(b) by 548 days.

(21) Appl. No.: 16/328,906

(22) PCT Filed: Dec. 16, 2016

(86) PCT No.: PCT/KR2016/014842
§ 371 (c)(1),
(2) Date: Feb. 27, 2019

(87) PCT Pub. No.: WO2018/043835
PCT Pub. Date: Mar. 8, 2018

(65) Prior Publication Data

US 2019/0211425 A1 Jul. 11, 2019

(30) Foreign Application Priority Data

Aug. 29, 2016 (KR) ..... 10-2016-0110210

(51) Int. Cl.
*C22C 33/04* (2006.01)
*C22C 38/04* (2006.01)
(Continued)

(52) U.S. Cl.
CPC ..... *C22C 33/04* (2013.01); *C22C 33/06* (2013.01); *C22C 38/04* (2013.01); *C21C 7/076* (2013.01)

(58) Field of Classification Search
CPC ..... C21C 7/076; C22C 33/04; C22C 33/06; C22C 38/04
(Continued)

(56) References Cited

U.S. PATENT DOCUMENTS

| | | | |
|---|---|---|---|
| 4,505,745 | A | 3/1985 | Hamada et al. |
| 4,923,675 | A | 5/1990 | Svidunovich et al. |
| 2016/0053350 | A1 | 2/2016 | Han et al. |

FOREIGN PATENT DOCUMENTS

| | | | |
|---|---|---|---|
| CN | 102230056 A | * | 11/2011 |
| CN | 105452504 | | 3/2016 |

(Continued)

OTHER PUBLICATIONS

NPL: on-line translation of CN-102230056-A, Nov. 2011 (Year: 2011).*
NPL: on-line translation of TW 200920859 A, May 2009 (Year: 2009).*

(Continued)

*Primary Examiner* — Jie Yang
(74) *Attorney, Agent, or Firm* — Cantor Colburn LLP

(57) ABSTRACT

Provided is a method for producing alloy steel, the method comprising producing first alloy steel in a temperature holding furnace; maintaining the first alloy steel at a temperature of no lower than a melting point in the temperature holding furnace; and producing second alloy steel having an alloy content lower than the alloy content in the first alloy steel by melt mixing of the first alloy steel and molten steel. In the producing of the alloy steel, melting and storing of the ferroalloy are continuously performed, and thus, the temperature drop of the ferroalloy may be suppressed or prevented.

7 Claims, 3 Drawing Sheets

(51) Int. Cl.
*C22C 33/06* (2006.01)
*C21C 7/076* (2006.01)

(58) Field of Classification Search
USPC ..... 420/129
See application file for complete search history.

(56) References Cited

FOREIGN PATENT DOCUMENTS

| | | | |
|---|---|---|---|
| CN | 105838848 | A * | 8/2016 |
| JP | 487824 | | 1/1973 |
| JP | 2001107130 | | 4/2001 |
| JP | 2010501726 | | 1/2010 |
| JP | 2010280942 | | 12/2010 |
| JP | 2014227599 | | 12/2014 |
| JP | 2016519217 | | 6/2016 |
| KR | 20000019388 | | 4/2000 |
| KR | 100812017 | | 3/2008 |
| KR | 20090073979 | | 7/2009 |
| KR | 100929468 | | 12/2009 |
| KR | 101047912 | | 7/2011 |
| KR | 20140082025 | | 7/2014 |
| KR | 101439763 | | 9/2014 |
| TW | 200920859 | | 5/2009 |

OTHER PUBLICATIONS

NPL: on-line Translation of CN105838848A, Aug. 2016 (Year: 2016).*

International Search Report—PCT/KR2016/014842 dated May 19, 2017.

PCT Written Opinion—PCT/KR2016/014842 dated May 19, 2017, citing KR 10-1439763, KR 10-2014-0082025, KR 10-2000-0019388, JP 2014-227599 and KR 10-0929468.

Chinese Office Action—Chinese Application No. 201680088807.2 dated Jun. 28, 2020, citing TW 200920859, CN 105452504, and U.S. Pat. No. 4,923,675.

Japanese Office Action—Japanese Application No. 2019-510858 dated Dec. 3, 2019, citing JP 48-7824, JP 2010-280942, JP 2016-519217, JP 2010-501726 and JP 2001-107130.

European Search Report—European Application No. 16915315.2, dated Jul. 4, 2019, citing TW200 920 859, U.S. Pat No. 4,505,745, US 2016-053350, U.S. Pat. No. 4,923,675 and KR 2009 0073979.

* cited by examiner

METHOD FOR PRODUCING ALLOY STEEL

TECHNICAL FIELD

The present disclosure herein relates to a method for producing alloy steel, and more particularly, to a method for producing alloy steel, the method being capable of suppressing a temperature drop or contamination of the alloy steel.

BACKGROUND ART

In general, high manganese steels mean steels containing approximately 1-5 wt % of manganese. Recently, high functional products such as high-strength high-formability steel materials for vehicle have been developed, and high-manganese steel having a manganese content increased up to approximately 25 wt % is being produced.

The high-manganese steel is produced in such a way that while tapping molten steel completely refined in a converter, a manganese-containing metal or an alloy (hereinafter, referred to as a ferroalloy) is added to control the manganese concentration. At this point, when the added amount of ferroalloy increases, the heat amount required for melting the ferroalloy increases, and the required heat amount may be secured by raising the converter end point temperature of molten steel. However, when the converter end point temperature of molten steel is raised as such, the blow amount of oxygen increases and the concentration of oxygen in the molten steel increases. Accordingly, problems of a decrease in yield due to oxidation of the molten steel and erosion of converter refractories occur. Furthermore, there is a limitation in that due to a high dissolved oxygen concentration, the added amount of deoxidizer is increased during tapping, and the amount of slag thereby increases. Furthermore, there is a limitation in that an atmospheric oxidation generation amount increases due to a high temperature of the molten steel when adding the ferroalloy, and thereby causes a decrease in yield.

In order to solve such limitations, various methods are being attempted, and among these, a method is being applied in which the temperature of the molten steel is raised, after converter tapping, through a second refining process such as a ladle furnace (LF), Rheinstahl and Heraeus (RH), etc., and a ferroalloy is further added to correct the concentration of the ferroalloy in the molten steel. However, there is a difficulty in mass production of cast slab because the added amount of the ferroalloy is limited due to the limit in the capacity of correcting temperatures per unit time in the second refining, and a long processing time is required to thereby lead to a limit in increasing the number of continuous-continuous casting. Furthermore, there is a limitation in that the increase in the processing time in a steelmaking process causes an increase in unit production cost.

Thus, recently, a technique is being applied in which high-manganese steel is produced by preparing a molten ferroalloy in which a ferroalloy is melted, and mixing the molten ferroalloy with molten steel. This technique uses the molten ferroalloy and hence has a merit in that high-manganese steel may be produced without securing a heat source required for a small amount of heat correction and for melting a solid ferroalloy. However, during the time for producing the molten ferroalloy and melt mixing, a nitrogen absorption phenomenon occurs due to contact with the air, and thus, the nitrogen content in the molten ferroalloy excessively increases. In particular, as illustrated in FIG. 1, there is a limitation in that the higher the manganese content in the manganese steel, the rapider the increase in the saturation solubility of nitrogen. Therefore, there is a limitation in that an additional process is required for controlling the nitrogen content in the molten ferroalloy or in the high-manganese steel produced through melt mixing, and thus, an increase in processing time and an additional cost are caused.

DISCLOSURE OF THE INVENTION

Technical Problem

The present disclosure provides a method for producing alloy steel, the method being capable of ensuring cleanliness of the alloy steel.

The present disclosure provides a method for producing alloy steel, the method being capable of improving productivity by reducing the time for producing the alloy steel through omission or reduction of additional process time.

Technical Solution

In accordance with an exemplary embodiment, a method for producing alloy steel includes: producing first alloy steel in a temperature holding furnace; maintaining the first alloy steel at a temperature of no lower than a melting point in the temperature holding furnace; and producing second alloy steel having an alloy content lower than an alloy content in the first alloy steel by mixing the first alloy steel and molten steel.

The maintaining of the first alloy steel at a temperature of no lower than the melting point may include raising the alloy content in the first alloy steel by performing at least once the adding of at least any one of a ferroalloy and a molten ferroalloy into the first alloy steel.

The maintaining of the first alloy steel at a temperature of no lower than the melting point may include further charging molten steel into the temperature holding furnace.

In the maintaining of the first alloy steel at a temperature of no lower than the melting point, the alloy content in the first alloy steel may be controlled to be greater than approximately 25 wt % and no greater than approximately 50 wt %.

At least any one of the producing of the first alloy steel and the maintaining of the first alloy steel at a temperature of no lower than the melting point may include supplying the temperature holding furnace with a heat source.

The producing of the second alloy steel may include mixing fourth alloy steel which is produced by adding, into the second molten steel, any one of a ferroalloy and a molten ferroalloy in the tapping of the completely refined second molten steel, and an alloy content in the fourth alloy steel may be lower than the alloy content in the first alloy steel.

The producing of the first alloy steel in the temperature holding furnace may include: charging first molten steel in the temperature holding furnace; and adding at least any one of a ferroalloy and a molten ferroalloy into the first molten steel.

The charging of the first molten steel into the temperature holding furnace may include introducing, into the temperature holding furnace, slag to be positioned on a melt surface of the first molten steel, and in the maintaining of the first alloy steel at a temperature of no lower than the melting point, a slag layer may be formed on the melt surface of the first alloy steel by using the slag.

The producing of the first alloy steel in the temperature holding furnace may include: tapping a completely refined first molten steel; adding, into the first molten steel, at least any one of a ferroalloy and a molten ferroalloy and producing third alloy steel; charging the third alloy steel into the temperature holding furnace; and adding, into the third alloy steel, at least any one of a ferroalloy and a molten ferroalloy and producing first alloy steel having an alloy content more than an alloy content in the third alloy steel.

Advantageous Effects

In accordance with an exemplary embodiment, molten steel is charged into a temperature holding furnace, a ferroalloy and a molten ferroalloy are added to produce first alloy steel, and second alloy steel having a target alloy content may be produced by mixing the first alloy steel and the molten steel. Here, the first alloy steel may have an alloy content which is lower than the alloy content in the molten ferroalloy produced by melting a metal or the ferroalloy and is higher than the alloy content in the second alloy steel. Accordingly, compared to a typical art in which alloy steel is produced by mixing a molten ferroalloy and molten steel, contamination, for example, nitrogen adsorption, of the alloy steel which may occur due to contact with the air in the producing of the alloy steel may be suppressed or prevented.

Thus, cleanliness of alloy steel is secured and a post-process may be omitted or the time spent for the post-process may be reduced, and thus the productivity of the alloy steel may be improved. Accordingly, the alloy steel required for casing may effectively be supplied, and thus, the casting efficiency may also be improved.

MODE FOR CARRYING OUT THE INVENTION

Hereinafter, exemplary embodiments will be described in detail. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

First, a method for producing alloy steel according to an exemplary embodiment may produce second alloy steel having a target alloy content through melt mixing of first alloy steel having a higher alloy content and molten steel. That is, unlike a typical method, for producing alloy steel, in which alloy steel is produced by adding a solid ferroalloy in molten steel, or through melt mixing of a ferroalloy and molten steel, second alloy steel may be produced by melt mixing of first alloy steel, having a more alloy content than a target alloy content, and molten steel. Here, the first alloy steel is produced in a temperature holding furnace shielded from the outside, and hence may be maintained at the temperature of no lower than the melting point thereof while suppressing a phenomenon in which the first alloy steel is contaminated, for example, the first alloy steel absorbs nitrogen. Accordingly, the cleanliness of the first alloy steel may be secured, so that a post-process for the second alloy steel, which is produced through melt mixing of the first alloy steel and molten steel, may be omitted or reduced, and thus, the total process time may be reduced and productivity may be improved.

Figure 2:
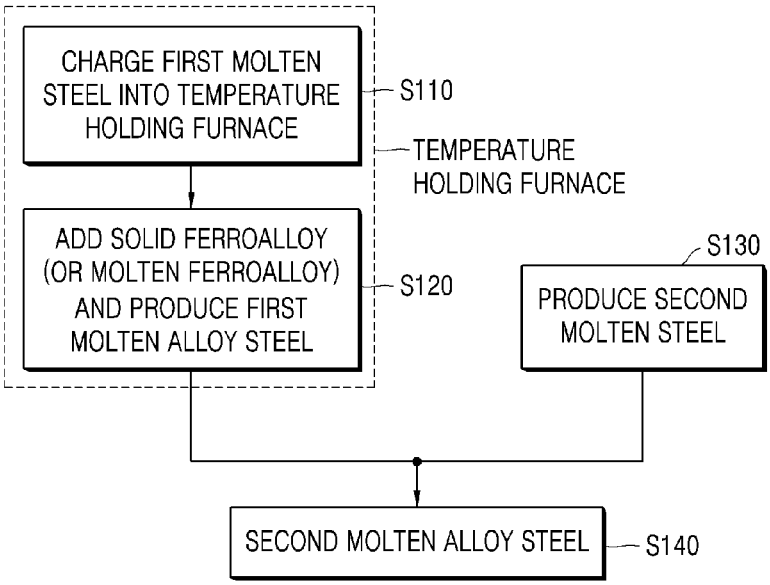
FIG. 2 is a flowchart showing a method for producing alloy steel in accordance with an exemplary embodiment.

FIG. 2 is a flowchart showing a method for producing alloy steel in accordance with an exemplary embodiment.

Referring to FIG. 2, a method for producing alloy steel in accordance with an exemplary embodiment may include: charging first molten steel completely refined in a converter (S110); inserting at least any one of a solid ferroalloy and a molten ferroalloy into a temperature holding furnace in which the first molten steel has been inserted and producing a first ferroalloy (S120); preparing second molten steel (S130); and producing second alloy steel by melt mixing of the first alloy steel and the second molten steel (S140). Here, the ferroalloy may be pure metal or an alloy, such as manganese metal or a manganese alloy containing manganese. In addition, the ferroalloy may be produced by smelting manganese metal or a manganese alloy containing manganese in a separate smelting furnace. The first alloy steel may contain various materials such as nickel, chrome, or the like in addition to manganese. Hereinafter, an example in which the first alloy steel contains manganese will be described, manganese metal or a manganese alloy will be referred to as manganese, and melted manganese metal or a melted manganese alloy will be referred to as molten manganese.

The first alloy steel may have a higher alloy content than the second alloy steel having a target alloy content or alloy concentration, that is, a manganese content (or a manganese concentration), and have a lower alloy content than the molten ferroalloy. For example, the manganese content in the first alloy steel may be greater than approximately 25 wt % and no greater than approximately 50 wt %. The reason why the upper limit of the manganese content in the first alloy steel is set to be no greater than approximately 50 wt % is because in general, when the content of an alloy in steel is no greater than approximately 50 wt %, the steel is considered as alloy steel, and when exceeding approximately 50 wt %, the steel is considered as a ferroalloy. In addition, as described above, the higher the manganese content in manganese steel, the rapider the increase in the nitrogen saturation solubility, and thus, when the manganese content excessively increases, there is a limitation in that a denitrification process is inevitable due to a nitrogen adsorption phenomenon, and much time is spent on the denitrification process. Thus, compared to a typical art in which alloy steel is produced by melt mixing of molten steel and a molten ferroalloy which has a manganese content of greater than approximately 50 wt %, for example, contains approximately 80 wt % of manganese, the second alloy steel is produced by melt mixing of molten steel and a molten alloy steel having a lower manganese content than that in the typical art, and thus, the nitrogen adsorption to the molten alloy steel is suppressed and the nitrogen content in the finally produced alloy steel may be reduced.

When solid manganese is added into the first molten steel in producing the first alloy steel, the ferroalloy may be melted by the heat of the first molten steel or the manganese may also be melted by further providing a heat source. At this point, the ferroalloy may be preheated and added so that the ferroalloy may easily be melted by the heat of the first molten steel, and a heat source supply means such as an induction coil may be provided to the temperature holding furnace so that a required heat source may be supplied when producing the first alloy steel.

In addition, when molten manganese is added to the first molten steel in producing the first alloy steel, a heat source may further be supplied if necessary, or may not be supplied. When a heat source is further provided, a smaller amount of heat source may be supplied than that when solid manganese is added.

The first alloy steel produced in the temperature holding furnace may be maintained at a temperature of no lower than the melting point thereof inside the temperature holding furnace until melt mixing with the second molten steel. At this point, while maintaining the first alloy steel, a denitrification process may further be performed inside the temperature holding furnace to remove the nitrogen component in the first alloy steel.

Meanwhile, slag may be formed on the melt surface of the first alloy steel stored in the temperature holding furnace so as to suppress the nitrogen adsorption phenomenon of the first alloy steel. In other words, while charging the first molten steel into the temperature holding furnace to produce the first alloy steel, the slag present on the melt surface of the first molten steel may be mixed with the first molten steel and charged into the temperature holding furnace. The slag has $CaO—Al_2O_3$ as a main ingredient, and may cover the melt surface of the first molten steel inside the temperature holding furnace and prevent the melt surface from contacting the air present inside the temperature holding furnace. The slag may naturally flow into the temperature holding furnace while charging the first molten steel into the temperature holding furnace, or may forcibly be introduced to form a slag layer on the melt surface of the first molten steel. In this case, while producing the first alloy steel by adding manganese or molten manganese and maintaining the first alloy steel, the nitrogen adsorption is suppressed, so that the denitrification process of the first alloy steel may be omitted, or the additional denitrification process time may be reduced.

In addition, while maintaining the first alloy steel in the temperature holding furnace at a temperature of no lower than the melting point thereof, manganese or molten manganese may further be added, so that the manganese content in the first alloy steel may gradually be increased within the above-mentioned range. As such, when the manganese content in the first alloy steel is gradually increased, the amount of the first alloy steel subjected to melt mixing with the second molten steel may be reduced. Accordingly, since the amount of the second molten steel subjected to melt mixing with the first alloy steel is relatively increased, there is a merit in that the amount of second alloy steel required for casing may be sufficiently secured, and the time and costs spent for producing the first alloy steel may be reduced.

At this point, when the manganese or molten manganese is continuously added to the first alloy steel, the manganese content in the first alloy steel may exceed the indicated range. In such a case, the first molten steel may further be added to adjust the manganese content in the first alloy steel within the indicated range.

When producing the first alloy steel, an inert gas such as argon (Ar) is blown into the temperature holding furnace to uniformly stir and mix the first molten steel, the manganese, and the molten manganese.

The first alloy steel produced through such a method may be produced in an amount greater than one batch amount used for melt mixing and be stored in the temperature holding furnace, and accordingly, a melt mixing process may continuously be performed, if necessary.

While the first alloy steel is produced and maintained at a temperature of no lower than the melting point, the second molten steel may be produced for melt mixing with the first alloy steel. The second molten steel may be carbon steel completely refined in a converter, and, for example, may contain approximately 0.2 wt % to approximately 0.4 wt % of carbon.

Subsequently, when the second molten steel is produced, the first alloy steel stored in the temperature holding furnace may be tapped and the melt mixing of the second molten steel and the first alloy steel is performed, and thus, the second alloy steel may be produced. At this point, according to a target manganese content in the second alloy steel and the manganese content in the produced first alloy steel, the ratio of melt mixing of the first alloy steel and the second molten steel may be adjusted.

After alloy steel, for example, the second alloy steel is produced through the above method, the second alloy steel is transported to casting equipment and casting may be performed. At this point, before transporting the second alloy steel to the casing equipment, in order to slightly adjust the manganese content in the second alloy steel or remove impurities in the second alloy steel, a refining process such as an LF process or a vacuum process may also be performed.

Hereinafter, a method for producing alloy steel may be described through various modified exemplary embodiments.

Figure 3:
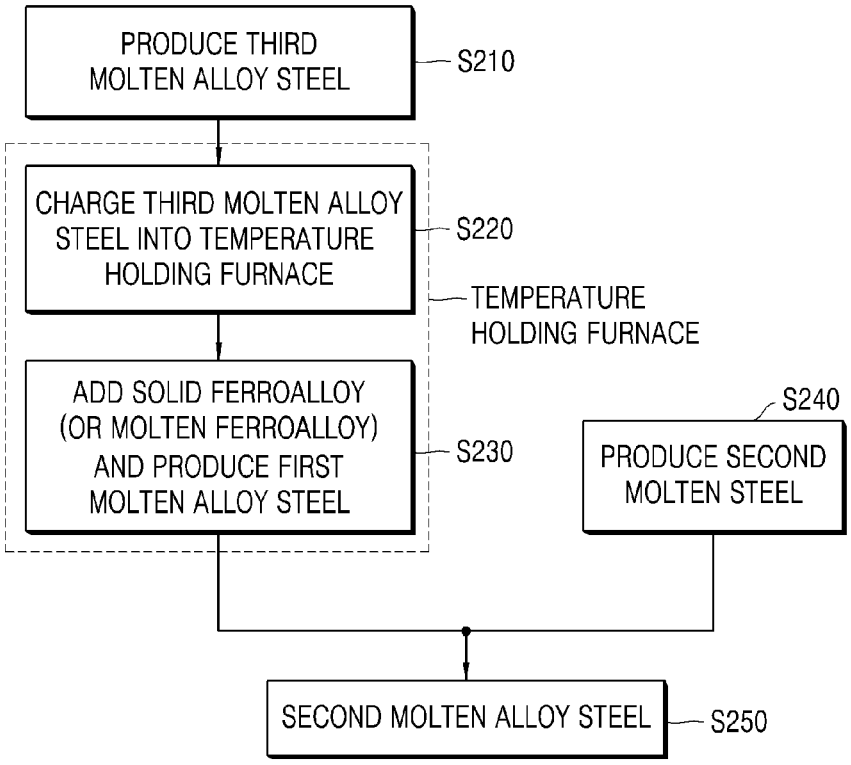
FIG. 3 is a flow chart sequentially showing a method for producing alloy steel in accordance with an exemplary embodiment.
Figure 4:
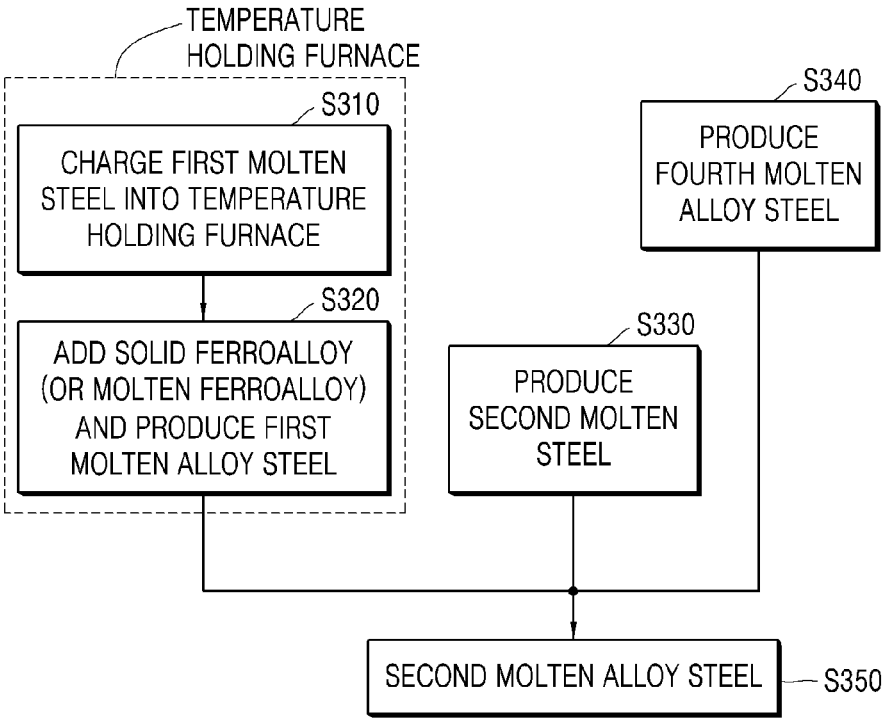
FIG. 4 is a flowchart sequentially showing a method for producing alloy steel in accordance with a modified exemplary embodiment.

FIG. 3 is a flowchart sequentially showing a method for producing alloy steel in accordance with a modified exemplary embodiment, and FIG. 4 is a flowchart sequentially showing a method for producing alloy steel in accordance with another modified exemplary embodiment. Here, the difference from the exemplary embodiment described above will be described. Besides, forming a slag layer on the melt surface of first alloy steel, supplying a heat source to a temperature holding furnace, further adding first molten steel to adjust the manganese content in the first alloy steel, or the like may be performed in the same way.

Referring to FIG. 3, a method for producing alloy steel in accordance with a modified exemplary embodiment may include: producing third alloy steel at the outside of a temperature holding furnace (S210); charging the third alloy steel into the temperature holding furnace (S220); adding at least any one of manganese and molten manganese into the temperature holding furnace and producing first alloy steel (S230); producing second molten steel (S240); and melt mixing the first alloy steel and the second molten steel to produce second alloy steel (S250). This modified exemplary embodiment may produce alloy steel through almost the same method as the above-mentioned exemplary embodiment except for the producing of the first alloy steel.

The producing of the third alloy steel may be performed such that at least any one of manganese or molten manganese is added to the first alloy steel. In the exemplary embodiment, first molten steel is directly charged into the temperature holding furnace to produce first alloy steel, but in the modified exemplary embodiment, the first molten steel is not charged into the temperature holding furnace but is produced at the outside of the furnace, and is then charged into the temperature holding furnace and may be used for producing the first alloy steel.

For example, in a process of tapping the first molten steel completely refined in a converter, at least any one of manganese and molten manganese may be added to the first alloy steel to produce the third alloy steel. At this time, the third alloy steel may be produce so as to have a lower manganese content than the manganese content in the first alloy steel to be produced later. This is because when the manganese content in the third alloy steel is too high, a nitrogen adsorption phenomenon may rapidly occur due to contact with the air. For example, the third alloy steel may be produced so as to have the manganese content of approximately 0.5 wt % to approximately 20 wt % in the third alloy steel.

After charging the third alloy steel into the temperature holding furnace, manganese and molten manganese are further added in almost the same way as that in the exemplary embodiment to produce the first alloy steel, and the second alloy steel may be produced by melt mixing of the first alloy steel and the second molten steel.

Aside from this, the first alloy steel may also be produced by charging the third alloy steel into the temperature holding furnace, and further adding the first molten steel, manganese and molten manganese.

Referring to FIG. 4, a method for producing alloy steel in accordance with another modified exemplary embodiment may include: charging first molten steel into a temperature holding furnace (S310); adding at least any one of manganese and molten manganese into the first molten steel and producing first alloy steel (S320); producing second molten steel (S330); producing fourth alloy steel at the outside of the temperature holding furnace (S340); and melt mixing the first alloy steel, the fourth alloy steel, and second molten steel to produce second alloy steel (S350).

This modified exemplary embodiment may be performed by combining, with the producing method of second alloy steel in accordance with the exemplary embodiment described above, the further producing of the fourth alloy steel produced at the outside of the temperature holding furnace and the melt mixing with the fourth alloy steel. The fourth alloy steel may be produced by using the completely refined third molten steel, and may be produced by almost the same way as the above-mentioned producing of the third alloy steel. In addition, the fourth alloy steel may be produce so as to have a lower manganese content than the manganese content in the first alloy steel. In addition, the fourth alloy steel may be produced so as to have the same as or similar alloy content to the third alloy steel. This is because the fourth alloy steel is produced at the outside of the temperature holding furnace and nitrogen adsorption phenomenon to the fourth alloy steel may occur due to contact with the air, and thus, in order to suppress the nitrogen adsorption phenomenon, it is desirable to control the manganese content in the fourth alloy steel to be relatively low.

When producing the second alloy steel through the above method, the produced amount of the first alloy steel may not be greatly increased, and thus, time and energy spent for producing and maintaining the first alloy steel may be reduced. In addition, alloy steel having excellent quality may be produced while avoiding burden of increasing the manganese content in the first alloy steel.

Hereinafter, experimental examples will be described in which the degree of nitrogen adsorption and the productivity improvement of the alloy steel produced through the method for producing alloy steel in accordance with an exemplary embodiment are examined. Here, manganese was used as an alloy material.

Firstly, the degree of nitrogen adsorption according to manganese contents was examined when alloy steel was maintained for a predetermined time inside a temperature holding furnace, and the experimental result was described in Table 1 below. In this experiment, alloy steel and a molten ferroalloy were charged into a temperature holding furnace, a sample was gathered after a predetermined time elapsed from the time when the charged amount of each of the alloy steel and the molten ferroalloy reached approximately 100 tons, and the nitrogen content was measured.

Experimental Example 1

Alloy steel having a manganese content of approximately 47.8 wt % was maintained in a temperature holding furnace for approximately 24 hours, and then, the concentration of nitrogen contained in the alloy steel was measured. In experimental example 1, a slag layer was not formed on the alloy steel.

Experimental Example 2

Alloy steel having a manganese content of approximately 45.9 wt % was maintained in a temperature holding furnace for approximately 26 hours, and then, the concentration of nitrogen contained in the alloy steel was measured. In experimental example 2, a slag layer was formed on the melt surface of the alloy steel.

Experimental Example 3

Alloy steel having a manganese content of approximately 81.5 wt % was maintained in a temperature holding furnace for approximately 49 hours, and then, the concentration of nitrogen contained in the alloy steel was measured. As described above, when the manganese content exceeds approximately 50 wt %, the alloy steel is closer to a ferroalloy than to alloy steel.

TABLE 1

| Division | Manganese content (wt %) | Nitrogen content (wt %) | Maintaining time of first alloy steel in temperature holding furnace (hours) |
|---|---|---|---|
| Experimental example 1 | 47.8 | 0.086 | 24 |
| Experimental example 2 | 45.9 | 0.041 | 26 |
| Experimental example 3 | 81.23 | 0.112 | 21 |

Comparing the results of experimental example 1 and experimental example 2, the alloy steel of the experimental example 1 and the alloy steel of experimental example 2 have manganese contents of approximately 2 wt % and the difference in the manganese contents is not remarkable. However, comparing the nitrogen content in the alloy steel, it may be found that the alloy steel of experimental example 2 has a nitrogen content which is only approximately one half of that of experimental example 1. It is interpreted that this is because in experimental example 2, a slag layer is formed on the melt surface of the alloy steel and thus contact between the alloy steel and the air is prevented inside the temperature holding furnace, and thus, the nitrogen adsorption is prevented.

Figure 1:
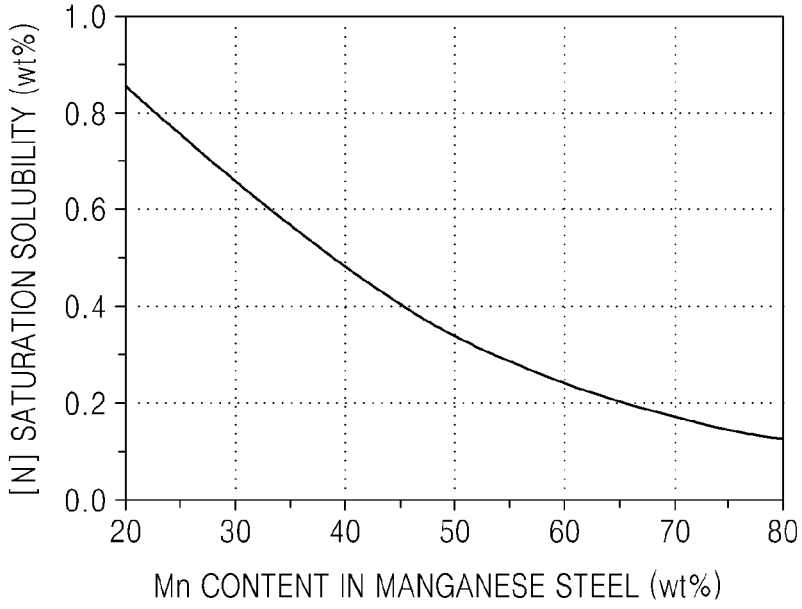
Fig. 1 Prior Art
FIG. 1 is a graph showing a change in nitrogen saturation solubility according to the manganese content in molten steel.

In addition, comparing the results of experimental examples 1 and 2 and experimental example 3, in the case of the molten ferroalloy of experimental example 3, the manganese content is almost two times the manganese contents of the alloy steels of experimental examples 1 and 2. It may be found that the molten ferroalloy of experimental example 3 contains nitrogen approximately two to five times more than the alloy steels of experimental examples 1 and 2 because a great amount of nitrogen components are introduced inside the temperature holding furnace. Furthermore, in the case of experimental example 3, although the maintaining time inside the temperature holding furnace is shorter than those of experimental examples 1 and 2, the nitrogen content is high. This is because although FIG. 1 shows the nitrogen saturation solubility in a state in which manganese steel is in contact with the air, the greater the manganese content, the rapider the increase in the nitrogen saturation solubility due to the characteristics of the manganese steel, and thus the nitrogen adsorption actively occurs.

Through such experimental results, it could be found that even in a state of being shielded from the air, the greater the manganese content, the more rapidly the nitrogen adsorption phenomenon occurs, and thus, when the manganese content was adjusted within an appropriate range, contamination of the alloy steel may be minimized by suppressing the nitrogen adsorption phenomenon.

In the next experiment, when producing alloy steel through the method for producing alloy steel in accordance with an exemplary embodiment, changes in the nitrogen content in the alloy steel were measured according to increases in the alloy content, that is, the manganese content in the alloy steel inside a temperature holding furnace.

Experimental Example 4

Completely refined molten steel was charged into a temperature holding furnace, alloy steel was produced by adding manganese metal, a manganese ferroalloy, and a molten manganese ferroalloy, and changes in the nitrogen content were measured according to the added amounts thereof.

TABLE 2

| Division | Manganese content (wt %) | Nitrogen content (wt %) |
|---|---|---|
| Experimental example 4 | 0.4 | 0.011 |
| | 18.3 | 0.039 |
| | 37.1 | 0.046 |

Referring to Table 2, the greater the added amounts of the manganese metal, the manganese ferroalloy, and the molten manganese ferroalloy into the molten steel, the gradually greater the nitrogen content contained in the alloy steel. However, even when the nitrogen content of the alloy steel increases according to the added amounts of the manganese metal, the manganese alloy ferroalloy, and the molten manganese ferroalloy, it may be found that the nitrogen content does not rapidly increase like the molten ferroalloy of experimental example 3, and a relatively low level of nitrogen content, for example, those in the ferroalloy of experimental examples 1 and 2 may be maintained.

Finally, when producing alloy steel through the method for producing alloy steel in accordance with an exemplary embodiment, an experiment was performed in which the time spent from melt mixing of the alloy steel and molten steel to casting was measured.

Experimental Example 5

During tapping from a converter, manganese metal was added and melted into the first molten steel and was then charged to a temperature holding furnace, and a molten manganese alloy was added to the temperature holding furnace to produce first alloy steel having a manganese content of approximately 49 wt %. In addition, while tapping second molten steel completely refined in the converter and adding approximately 10 tons of manganese metal, melt mixing with approximately 80 tons of the first alloy steel was performed to produce second alloy steel. Subsequently, in an LF process, approximately 5 tons of manganese metal was charged into the second alloy steel, and the second alloy steel was controlled so as to have a manganese content of, for example, approximately 21.7 wt % and was then transported to casting equipment. At this point, the time spent from the melt mixing of the first alloy steel and the second molten steel, that is, from the tapping of the second molten steel to transportation to the casting equipment was measured to be approximately 230 minutes.

Experimental Example 6

While tapping completely refined molten steel, manganese metal was added to produce alloy steel in which the manganese content was firstly controlled. Subsequently, in an LF process, manganese was further added to the alloy steel in which the manganese content was firstly controlled, and alloy steel having the target manganese content was produced and transported to casting equipment. At this point, the amount of manganese metal added to the alloy steel in the LF process was approximately 15 tons and could be added by being divided over several times, and thus, adding of the manganese metal and a heating process could be repeatedly performed over several times. Through such processes, alloy steel having the manganese content of approximately 24.3 wt % was produced and transported to the casting equipment. At this point, the time spent from the tapping of the molten steel to the transportation to the casting equipment was measured to be approximately 361 minutes.

TABLE 3

| Division | Manganese content (wt %) | Nitrogen content (wt %) | Production time (min) converter tapping –> supply to continuous casting |
|---|---|---|---|
| Experimental example 5 | 21.7 | 0.0091 | 230 |
| Experimental example 6 | 24.3 | 0.0219 | 361 |

Referring to Table 3, it may be found that in case of experimental example 5, the time from the tapping of the molten steel to the transportation to the casting equipment so as to be used in casting is reduced by approximately 131 minutes compared to that in experimental example 6. This is the time spent in the LF process performed after melt mixing, and since in experimental example 5, the manganese content in the second alloy steel was controlled by using the first alloy steel mainly produced in the temperature holding furnace, the nitrogen content in the second alloy steel may be controlled to be low as in experimental examples 1, 2 and 4 described above, and thus, the time spent for the LF process may be reduced.

Conversely, in the case of experimental example 6, when the molten steel was tapped from the converter, manganese metal was added and melted to produce the alloy steel, and in the LF process, manganese metal was further added to control the manganese content in the alloy steel. At this point, the added amount of manganese metal to the alloy steel in the LF process of experimental example 6 may be approximately 3 times more than the added amount of manganese metal to the second alloy steel in the LF process of experimental example 5. Accordingly, in experimental example 6, the manganese metal added to the alloy steel was added by being divided into several times, and every time when the manganese metal was added, a process for raising the temperature of the alloy steel was performed. Accordingly, in experimental example 6, the time spent for the LF process inevitably increased, and thus, much time had to be spent for providing the alloy steel used for casting.

In addition, referring to Table 3, in experimental example 6, the LF process time is longer than in that in experimental example 5, and thus, after completing the LF process, it is desirable that the nitrogen content in the alloy steel be measured to be lower than that in experimental example 5. However, in experimental example 6, since the producing of the alloy steel is performed in a state of being exposed to the air, an initial nitrogen content in the alloy steel before the LF process is very high, and since there is a limit in the capability of removing nitrogen by the LF process, the nitrogen content in the second alloy steel produced by experimental example 5 is measured to be lower.

Through the above-mentioned experimental results, it could be found that in a method for producing alloy steel in accordance with an exemplary embodiment, alloy steel having a target alloy content was produce by melt mixing of molten steel and alloy steel having a lower alloy content than a molten ferroalloy, and thus, contamination due to contact with the air, for example, a nitrogen adsorption phenomenon, could be minimized. In addition, it could be found that contamination of the alloy steel was minimized, and the time spent for a post-process, for example, a LF process, was thereby reduced, so that the overall time spent from the producing of the alloy steel to casting was reduced and productivity could be improved.

A casting method in accordance with an exemplary embodiment is a method for casting a casting such as a cast slab using alloy steel containing an alloy such as manganese, and before performing casting, the time for which the alloy steel is exposed to air is reduced as much as possible, the alloy steel may be prevented from contamination or temperature drop due to the air. Accordingly, the alloy steel is produced just before performing casting and being used in the casting, and furthermore, the producing of the alloy steel is performed in the casting equipment, and thus, a temperature drop or contamination of the alloy steel due to contact with the air may be minimized.

As such, in the exemplary embodiment, a molten ferroalloy is prepared by melting a solid ferroalloy, storing the molten ferroalloy at a temperature of no lower than the melting point, producing alloy steel by melt mixing of the molten ferroalloy and molten steel just before casting, and using the alloy steel in the casting, and thus, a temperature drop or contamination, which may occur in the alloy steel producing process, may be minimized. In addition, since the producing of the alloy steel and the casting are continuously performed, the time spent after the producing of the alloy steel until the casting is reduced, and thus, an additional process required due to a temperature drop of contamination of the alloy steel may be omitted. Accordingly, an increase in costs due to the additional process may be suppressed and the process efficiency and productivity may be improved.

While the technical idea of the present invention has been specifically described in accordance with the above embodiments, it should be noted that the foregoing embodiments are provided only for illustration while not limiting the present disclosure. In addition, various embodiments may be provided to allow those skilled in the art to understand the scope of the preset invention.

INDUSTRIAL APPLICABILITY

A method for producing alloy steel in accordance with an exemplary embodiment may secure cleanliness of alloy steel and omit a post-process or reduce the time spent for the post-process, and thus may improve the productivity of the alloy steel.

What is claimed is:

1. A method for producing alloy steel, the method comprising:

producing first alloy steel in a temperature holding furnace shielded from the outside;

maintaining the first alloy steel at a temperature of no lower than a melting point in the temperature holding furnace;

preparing molten steel;

tapping the first alloy steel from the temperature holding furnace; and producing second alloy steel having an alloy content lower than an alloy content in the first alloy steel by mixing the first alloy steel and the molten steel, wherein the maintaining of the first alloy steel at the temperature of no lower than the melting point comprises: raising the alloy content in the first alloy steel more than the alloy content in the second alloy steel by performing at least once adding at least one of a solid ferroalloy and a molten ferroalloy into the first alloy steel; and removing nitrogen in the first alloy steel in the temperature holding furnace.

2. The method of claim 1, wherein, in the maintaining of the first alloy steel at the temperature of no lower than the melting point, the alloy content in the first alloy steel is controlled to be greater than 25 wt % and no greater than 50 wt %.

3. The method of claim 2, wherein at least anyone of the producing of the first alloy steel and the maintaining of the first alloy steel at the temperature of no lower than the melting point comprises: supplying the temperature holding furnace with a heat source.

4. The method of claim 3, wherein the producing of the second alloy steel comprises mixing fourth alloy steel which is produced by adding, into the second molten steel, at least any one of a solid ferroalloy and a molten ferroalloy in the tapping of the completely refined second molten steel, and an alloy content in the fourth alloy steel is lower than the alloy content in the first alloy steel.

5. The method of claim 1, wherein the producing of the first alloy steel in the temperature holding furnace comprises:

charging first molten steel in the temperature holding furnace; and adding at least any one of a solid ferroalloy and a molten ferroalloy into the first molten steel.

6. The method of claim 5, wherein the charging of the first molten steel into the temperature holding furnace comprises introducing, into the temperature holding furnace, slag to be positioned on a melt surface of the first molten steel, and in the maintaining of the first alloy steel at the temperature of no lower than the melting point, a slag layer is formed on the melt surface of the first alloy steel by using the slag.

7. The method of claim 1, wherein the producing of the first alloy steel in the temperature holding furnace comprises:

tapping completely refined first molten steel;

adding, into the first molten steel, at least any one of a solid ferroalloy and a molten ferroalloy and producing third alloy steel;

charging the third alloy steel into the temperature holding furnace; and adding, into the third alloy steel, at least any one of a solid ferroalloy and a molten ferroalloy and producing first alloy steel having an alloy content more than an alloy content in the third alloy steel.

* * * * *